US009039106B2

(12) United States Patent
Riley

(10) Patent No.: US 9,039,106 B2
(45) Date of Patent: May 26, 2015

(54) CONVERTIBLE FURNITURE SYSTEM BASE AND MODULAR APPLICATIONS INCLUDING ARMCHAIRS, TABLES, AND STORAGE CABINETS

(71) Applicant: Michael D. Riley, Glendale, AZ (US)

(72) Inventor: Michael D. Riley, Glendale, AZ (US)

(73) Assignee: Michael D. Riley, Glendale, AZ (US)

( * ) Notice: Subject to any disclaimer, the term of this patent is extended or adjusted under 35 U.S.C. 154(b) by 190 days.

(21) Appl. No.: 13/624,952

(22) Filed: Sep. 23, 2012

(65) Prior Publication Data

US 2014/0084765 A1 Mar. 27, 2014

(51) Int. Cl.

| | |
|---|---|
| ***A47B 43/00*** | (2006.01) |
| ***A47B 13/00*** | (2006.01) |
| ***A47B 91/00*** | (2006.01) |
| ***A47B 47/00*** | (2006.01) |
| ***A47C 4/02*** | (2006.01) |
| ***A47C 31/02*** | (2006.01) |

(52) U.S. Cl.

CPC ..... *A47C 4/021* (2013.01); *A47B 47/0091* (2013.01); *A47C 31/023* (2013.01)

(58) Field of Classification Search

CPC ..... A47B 2230/0085; A47B 2230/0088; A47B 2230/0092; A47B 3/06; A47B 47/0075; A47B 85/00; A47B 85/04

USPC ..... 312/257.1; 108/154, 158.12, 157.14, 108/157.1

See application file for complete search history.

(56) References Cited

U.S. PATENT DOCUMENTS

| | | | | |
|---|---|---|---|---|
| 191,733 | A | 1/1877 | True | |
| 321,230 | A | 6/1885 | Lewis | |
| 1,269,967 | A * | 6/1918 | Sill | 297/124 |
| 2,112,094 | A * | 3/1938 | Haskin | 312/233 |
| 2,362,426 | A * | 11/1944 | Wyatt | 108/91 |
| D155,273 | S | 9/1949 | Eames | |
| 2,481,671 | A * | 9/1949 | John et al. | 108/101 |
| 2,632,498 | A * | 3/1953 | Curtis | 297/440.13 |
| 2,656,045 | A * | 10/1953 | Curtis | 108/101 |
| 2,686,096 | A * | 8/1954 | Barnes, Jr. | 108/158.12 |
| 2,692,637 | A | 10/1954 | Rainwater | |
| 2,903,313 | A | 9/1959 | Block | |
| 3,211,506 | A * | 10/1965 | Levy et al. | 312/239 |
| 3,420,571 | A | 1/1969 | Moore | |
| 3,490,809 | A * | 1/1970 | Lange | 297/440.13 |
| 3,640,576 | A | 2/1972 | Morrison et al. | |
| 3,667,803 | A * | 6/1972 | Ford | 297/119 |
| 3,726,551 | A | 4/1973 | Levenberg | |
| 3,726,561 | A * | 4/1973 | Bolyos | 297/440.23 |
| 3,744,845 | A * | 7/1973 | Sooker | 297/423.44 |
| 3,767,237 | A | 10/1973 | Suchowski | |
| 3,966,337 | A * | 6/1976 | Crawford | 403/170 |
| 4,525,009 | A | 6/1985 | de la Sota Martinez | |
| 4,576,353 | A * | 3/1986 | Valeria | 248/165 |

(Continued)

*Primary Examiner* — Janet M Wilkens
*Assistant Examiner* — Timothy M Ayres

(57) ABSTRACT

The present invention pertains to a modular furniture system in which a flat-foldable or easily assembled and disassembled rigid base structure composed of rectangular-cross-sectioned pieces each with specific dimensions serves variously, once assembled, as the supporting framework for a flat-foldable chair seat-and-backrest module, which configured together with the base structure serves as either an upright dining chair with armrests or as a lower and more reclined lounge chair with armrests, or alternatively as configured for supporting the connectable or foldable components of a flat planar surface module to be used for dining or to serve as a desktop, or alternatively as configured for supporting a storage cabinet module with drawers or doors.

5 Claims, 12 Drawing Sheets

(56) References Cited

U.S. PATENT DOCUMENTS

| | | | | |
|---|---|---|---|---|
| 4,740,032 | A * | 4/1988 | Olsen et al. | 297/139 |
| 4,765,253 | A * | 8/1988 | Schappach | 108/158.12 |
| 5,085,447 | A | 2/1992 | Audibert | |
| 5,709,428 | A | 1/1998 | Hugghins | |
| 5,813,737 | A * | 9/1998 | Stone | 312/257.1 |
| 5,954,391 | A | 9/1999 | Gray | |
| 5,983,420 | A * | 11/1999 | Tilley | 5/2.1 |
| 7,370,907 | B2 * | 5/2008 | Leong | 297/2 |
| 7,516,708 | B2 * | 4/2009 | Willy et al. | 108/157.14 |
| 8,079,315 | B2 * | 12/2011 | Berent et al. | 108/158.12 |
| 2008/0245277 | A1 * | 10/2008 | Willy et al. | 108/28 |

* cited by examiner

CONVERTIBLE FURNITURE SYSTEM BASE AND MODULAR APPLICATIONS INCLUDING ARMCHAIRS, TABLES, AND STORAGE CABINETS

TECHNICAL FIELD

The present invention pertains to a modular furniture system in which a flat-foldable or easily assembled and disassembled rigid base structure composed of rectangular-cross-sectioned pieces each with specific dimensions serves variously, once assembled, as the supporting framework for a flat-foldable chair seat-and-backrest module, which configured together with the base structure serves as either an upright dining chair with armrests or as a lower and more reclined lounge chair with armrests, or alternatively as configured for supporting the connectable or foldable components of a flat planar surface module to be used for dining or to serve as a desktop, or alternatively as configured for supporting a storage cabinet module with drawers or doors.

BACKGROUND OF THE INVENTION

1. Field of the Invention

The heights of most tabletops, desktops, and chair seats and arms as well as chair widths have become somewhat standardized in the Western world in ergonomic response to the dimensions of the average contemporary adult human frame. Tabletop and desktop surfaces are generally raised between twenty-seven and twenty-nine inches above the floors that their legs or other supports rest upon. Dining chair seating surfaces are generally raised to roughly sixteen inches above the floor, with a slightly greater (typically one-half to one inch) elevation at their front edge above the rear edge next to the back of the chair. This sloping angle provides comfort for those who sit in the chair. The arm heights for these types of chairs are typically made short enough to fit under a tabletop of conventional depth, which depth is typically up to two inches. This dictates a maximum arm height for dining chairs of roughly twenty-five inches. Seating surfaces for lounge chairs are generally lower than those same surfaces for dining chairs, and more sharply sloped downward at their rear edges so as to provide a more reclining posture to those people who use them than do dining chair seats. The rear edge of lounge chair seats may thus be as little as nine to twelve inches above the floor that the chair rests upon.

Given these dimensions, the present invention is directed to the use of rectangular wooden boards, metal bars or rods, or plastic or metal tubes to compose the base structure of a modular, foldable or easily disassembled and reassembled and thus compactly storable and transportable furniture system. The system's interchangeable modules can be used cost-effectively to interchangeably compose a number of furniture applications, such as dining chairs and dining tables, worktables, or desktops, as well as lounge chairs and storage cabinets.

This modular furniture system supports a variety of furniture application modules on a base structure composed from rigid rectilinear materials with members composed of appropriately-sized rectangular cross-sections. This convertible framework can be used to support a single, removable, foldable chair seat and back module in either dining chair or lounge chair applications. Both chair applications provide the user with armrests. Whether the chair is used for a dining or lounge seating application is determined by the base structure's position after the seat-and-back module is removed from the base structure in either chair position and the base structure is then rotated by ninety degrees around one bottom-side axis and the seat-and-back module is re-inserted. Or the structure can be used for supporting a tabletop (or desktop or worktable, if the surface is used as such) after the seat-and-back module is removed and the framework is rotated ninety degrees around a different axis. The base structure in the dining or lounge chair positions can also be used to support a storage cabinet module with drawers or doors. Once erected, the base structure can be adapted to the desired application and support that module for which it is to be used by simply rotating the base structure to the proper erect position and inserting the application module, whether chair seat, table top, or cabinet.

The base structure may be formed from metal bars or wooden boards, or hollow plastic or metal tubes and straps of flexible materials, all configured with a rectangular cross section with dimensions for the members of roughly two-and-a-half to three inches in width, three-quarters of an inch in thickness and between roughly twenty to twenty-five inches in overall length. These dimensions will provide a uniform opening width of roughly eighteen inches for the seat-and-back module when held in both lounge and dining chair positions. These common dimensions permit the use of the same seat and backrest module in both applications.

The framework's bar, board, or tubular members are configured as perpendiculars in a roughly cubical shape, with sides forming two "H" shapes rotated by ninety degrees relative to each other on two opposing faces, two "U" shapes similarly positioned on two other opposing faces, and squares when viewed from the remaining two opposite faces. The removable seat is formed from two pieces of flexible material such as leather or fabric that are sewn or glued together at their rear edge, and that is equipped with corner pins or brackets or other bracing devices which permit the seat to be affixed securely in position on the framework. With the base structure is set in the dining chair position, any weight imposed on the frame will be borne up by three upright "legs," two at the front and one centered behind the seat. The overall height of the arms of the base in the dining chair position should be no more than approximately twenty-five inches in order to permit the arms of the chair to pass beneath the dining tabletop when it is in place on top of another copy of the base structure. If the rectangular cross-section of the arms of the chair is roughly two-and-a-half to three inches wide by three-quarters to one inch in depth, then the width between the arms of the base structure in the dining chair position and in the lounge chair position will be separated by a close-to-identical width. This will permit the use of the same folding seat module when the chair is configured in either position.

The tabletop can be made collapsible from two pieces of board which are pinned together and held in place by further pins inserted into the base structure. The cabinet module fits into the upper portion of the framework when it is placed in either the dining chair or lounge chair positions but minus the removable seat, and is held in place by an overhanging lip protruding over the side and rear edges of the framework structure and protruding pins that fit into the seat's mounting holes on the framework.

2. Description of the Prior Art

According to Wikipedia, the chair, as composed of a seat and a back supported by four legs, is a device of extreme antiquity that did not pass into popular use until the 16nth Century. The stool, composed only of a seat resting on three or four legs, is believed to be even more ancient. Until the Industrial Revolution, carpenters and other woodworking craftsmen seemed to focus most of their creative efforts on decorative embellishments rather than functional improvements to the design of commonplace furniture objects.

However, by the mid-Nineteenth Century urbanization made it increasingly common for even by persons of means to inhabit relatively compact dwelling spaces. This trend in turn created a growing interest in and demand for furniture that could serve a number of purposes. This was especially true for pieces that could be broken down into components or easily folded to permit them to be compactly stored when not in use.

These forces inspired such innovations as are evident in U.S. Pat. No. 191,733, issued to James P. True on Jan. 5, 1877, for a "Convertible chair," an upright upholstered arm chair that transforms into what is now called a recliner lounge chair, or in U.S. Pat. No. 321,230 issued on Jun. 30, 1885 to Edward H. Lewis for a somewhat similar "Convertible chair" that also converts from an upright chair to a lounge chair to a bed. By the early Twentieth Century, designs for folding dining-height and lounge chairs both with and without arms were common.

Subsequently patented art that incorporates at least one feature in common with the present invention include:

U.S. Design Pat. No. DI55273, issued on Sep. 20, 1949 to the now-famed furniture designer, Charles Eames, shows a chair with formed metal legs supporting a seat and a backrest, featuring only three legs with one leg in front.

U.S. Pat. No. 2,692,637, issued on Oct. 10, 1954 to Orman N. Rainwater for a "Folding Extensible Height Chair," shows a folding chair design composed of four "U"-shaped framing support components.

U.S. Pat. No. 2,903,313, issued on Sep. 8, 1959 to Walter W. Block, for a "Portable Folding Table" that features "U"-shaped supporting members.

U.S. Pat. No. 3,640,576 issued on Feb. 8, 1972 to Morrison, et.al, for a "Furniture Construction" consisting of a modular side chair or lounge chair, with or without arms, that features a seat and back composed of a single piece of flexible material suspended above the floor on two two-legged "U"-shaped base structures, either with or without arms, with the base structures held apart by two rigid rollers from which the flexible material is suspended.

U.S. Pat. No. 3,420,571 issued Jan. 7, 1969 to James C. Moore, for a "Collapsible Combination Chair and Desk," in which the desk is convertibly affixed to the rear of the folding chair.

Interest in modular office furniture systems burgeoned in the post-War period in America, with architects and engineers most often leading the way. As examples, U.S. Pat. No. 3,726,551 was issued on Apr. 10, 1973 to Nat Levenberg for a "Tubular Rigid Angled Joint" for a modular furniture system composed by means of tubular rectangular metal connectors. Somewhat similarly, U.S. Pat. No. 3,767,237, which was issued on Oct. 23, 1973 to Bernard Suchowski, describes a "Miter Frame Corner Construction," consisting of a device to reinforce the orthogonality of perpendicularly joined members.

U.S. Pat. No. 4,525,009, issued to de la Sota Martinez on Jun. 25, 1985, describes another "Chair changeable into easy chair" design for a tubular-membered, some members being "U"-shaped, upright chair that can be converted into a recliner-lounger by means of a partial rotation around the front edge of the chair.

U.S. Pat. No. 5,085,447, issued Feb. 4, 1992 to Jacques J. Audibert, describes a "Folding furniture structure." This folding modular concept can take the form of a table, upholstered lounge chairs, or bed, depending on how the components are rotated or collapsed about various axes.

U.S. Pat. No. 5,709,428 issued on Jan. 20, 1998 to Joel F. Hugghins, is for "Collapsible folding furniture." This design features a roll-up, flexible sling seat and back, and a frame that can be disassembled into a number of fairly short, straight pieces which can be stored together as a single, compact bundle.

U.S. Pat. No. 5,954,391, issued to Donald F. Gray on Sep. 21, 1999, is for a "Stable three legged folding chair." The chair includes both a seat and a back, but is based on a tripod configuration.

Even without known benefit of patent protections, contemporary furniture designers have continued to publicly explore many variations on what is sometimes called "transformable flat pack" multi-purpose, easily assembled, slotted furniture designs. As of the date of this filing, you may go to http://weburbanist.com/2008/01/13/more-creative-furniture-for-cramped-urban-living-20-pieces-of-ingenious-flat-pack-urban-furniture/ to see illustrations of these kinds of designs. Alternatively, Roel Verhagen Kaptein's 2007 "Transformer Chair" converts from a lounger to chaise lounge to sofa by means of axial rotation of connected components. To see an illustration of this design, use the Internet and go to http://www.yankodesign.com/2008/02/21/transformer-chair-more-than-meets-the-eye/. Two other contemporary designs for chairs that can be converted into chair and desk combinations by means of rotations of up to 180 degrees around their forward axis may be viewed on the Internet at http://dornob.com/flip-over-furniture-convertible-chair-and-desk-design/.

BRIEF SUMMARY OF THE INVENTION

Accordingly, the object of the system is to provide a means for a single modular furniture system to be used in a variety of related applications. One such application would be to serve as a dining chair or work chair with armrests. Another such application would be to serve as a lounge chair with armrests, in which the degree to which the seatback reclines can be set in varying positions as may be desired by the user. An additional such application would be to serve as a dining table, worktable, or desk, as the user's needs may dictate. A further application would include use as a storage cabinet furnished with drawers or doors.

Another object of this invention is to provide means to provide means for the compact storage and packaged transport of all of the modular components of the furniture system.

Yet another object is to provide means for the simple and rapid assembly and disassembly or folding and unfolding of the modular components of the furniture system, even without the use of tools or special equipment.

Another object is to provide means to produce the furniture system with great efficiency and economy by means of component modules fabricated from common materials, and designed in a manner that permits the modules to be used interchangeably in a number of system applications.

An additional object is to provide the base structure of the furniture system with rigid means of preserving the orthogonality of members that join at its outside rear corners, where the distorting forces of torque that will be exerted on the structure by the movements of users will be greatest.

A further object is to provide a variety of means for the construction of the component modules of the furniture system, so that its aesthetic appeal can be periodically refreshed and updated by means of significant changes in its appearance and materials.

A still further object is to provide a coherent, contemporary, and harmonious appearance to all of the components, modules, and applications of the furniture system, so as to accommodate the interior design considerations of users.

Further objects of the invention will be identified as the description proceeds. The attainment of these and related objects may be achieved through use of the modular furniture system herein disclosed. The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 20:
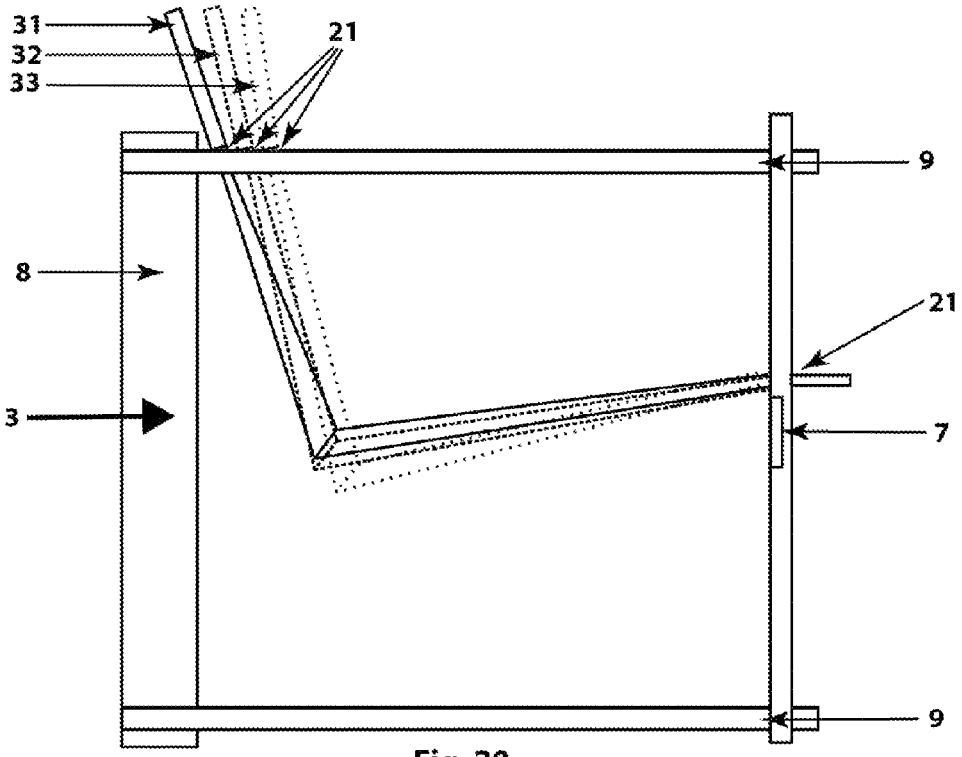
FIG. 20 is a side view of the assembled notch-slotted modular base structure and chair seat and back in the lounge chair position, showing the seat back in three alternative positions of inclination, as may be desired by the user and set by selecting which hole into which to insert the retaining pins.
Figure 21:
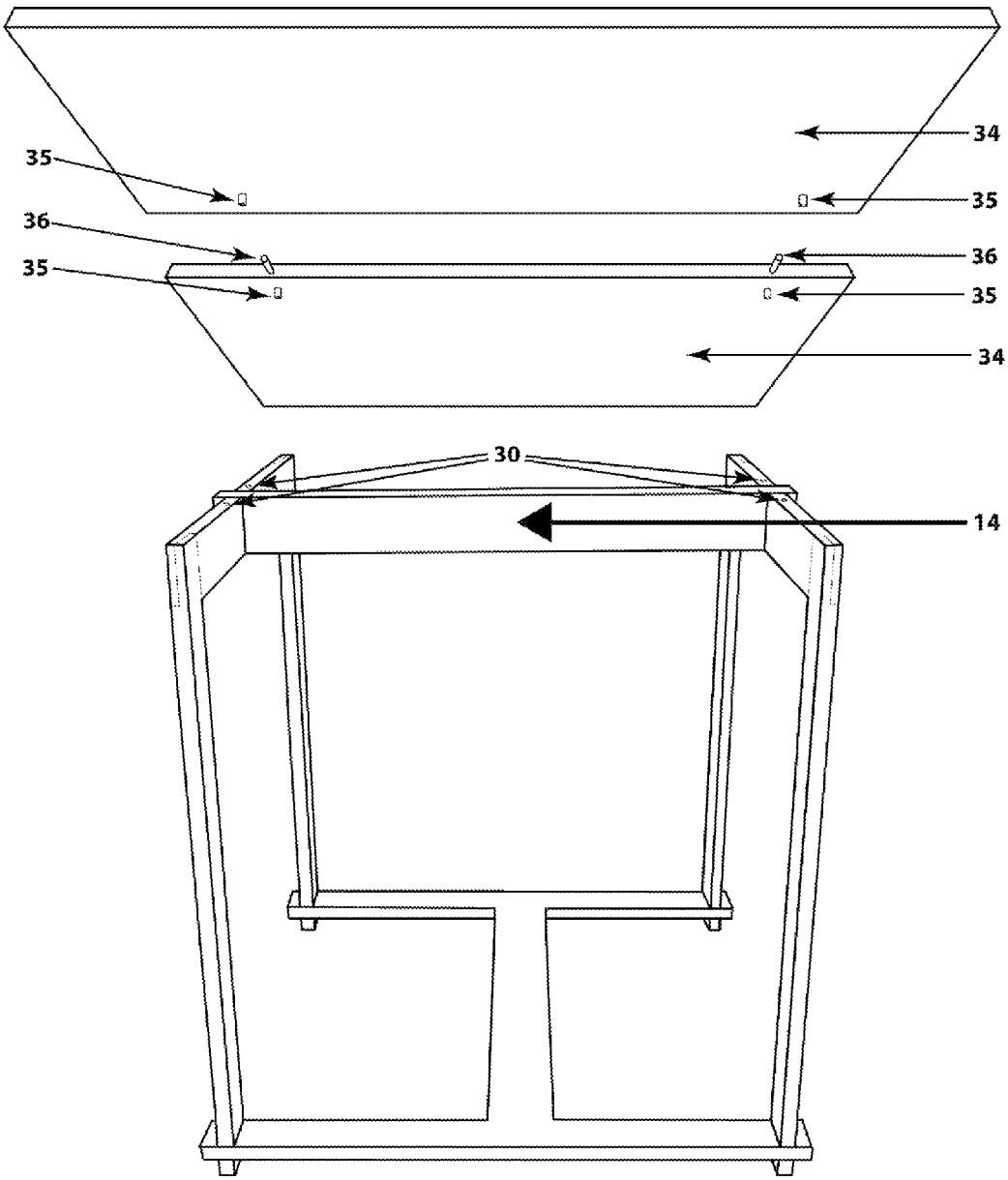
FIG. 21 is a detailed view of the assembled notch-slotted modular base structure rotated a further ninety degrees in order to form a platform on which an interlocked pair of flat boards can rest in a locked position by means of pins inserted into holes and thus serve as a dining table or work surface.
Figure 22:
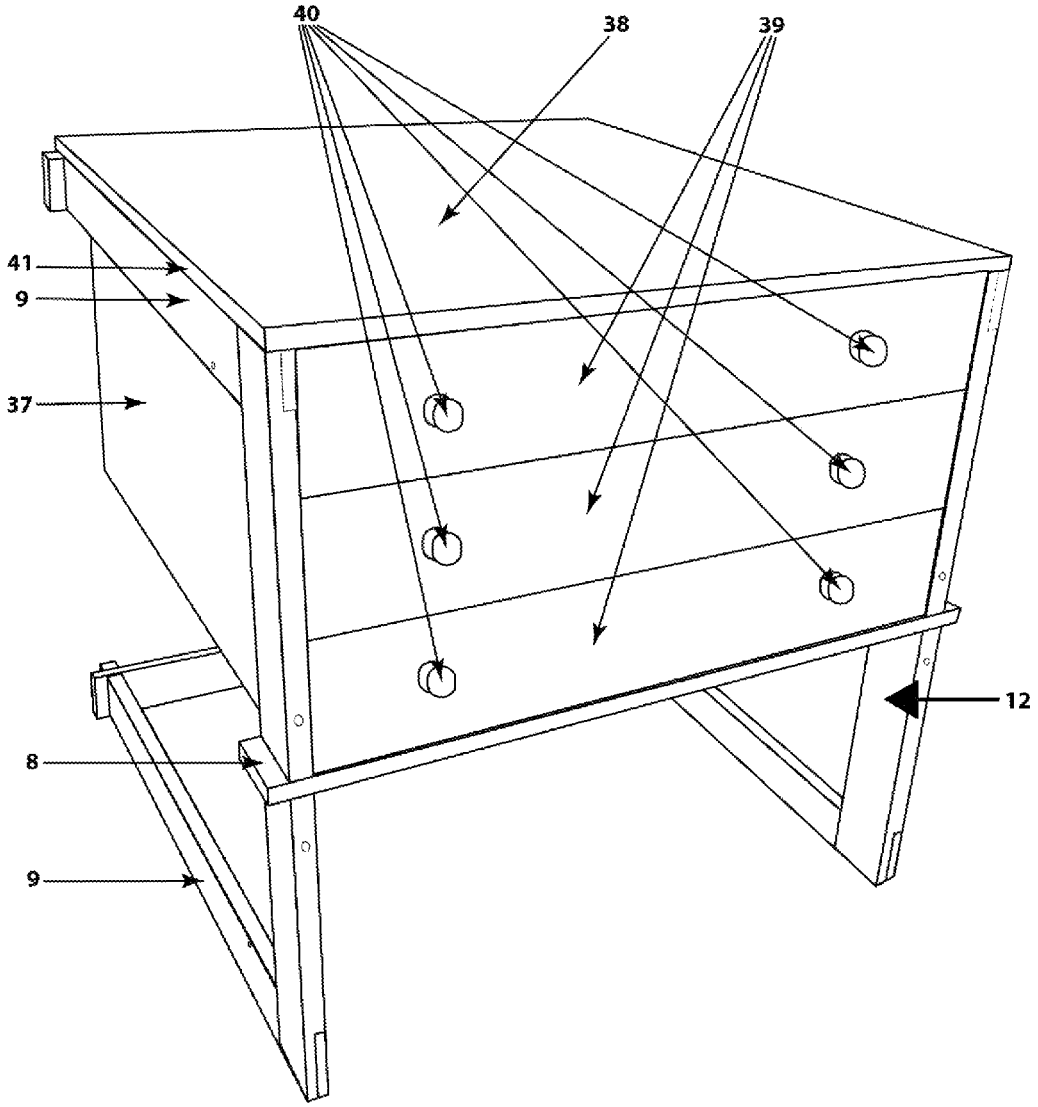
FIG. 22 is a view of the base structure in use as a framework and support for a cabinet; in this view the cabinet is depicted as containing three drawers in just the upper half of the framework.

We turn now to the drawings on a descriptive basis, with similar reference characters denoting similar elements in all of the several views. FIGS. 1 through 20 illustrate one of several forms of the present invention in order to portray and to explain many of its key features. This form is composed of easily assembled and disassembled, separable and flat-storing notched, interlocking components and a seat-and-back-rest module which can be easily assembled for use as a dining or lounge chair with armrests, and easily disassembled for compact storage or shipment. FIGS. 21 and 22 illustrate the manner in which the base structure shown in FIGS. 6 through 8 can be used to support modules that permit the assembled structure to be used variously as a worktable, dining table, desk surface, or storage cabinet.

Figure 1:
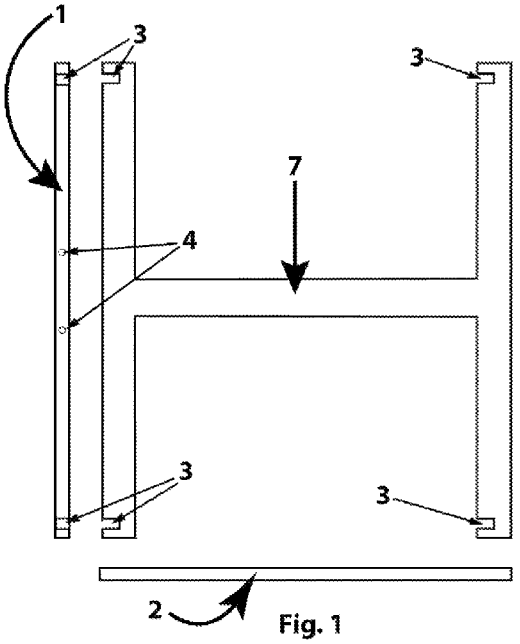
FIG. 1 is a three-sided orthographic view of the side, face, and edge of the "H-shaped" component to be used for the notch-slotted, modular base structure form of the invention.
Figure 2:
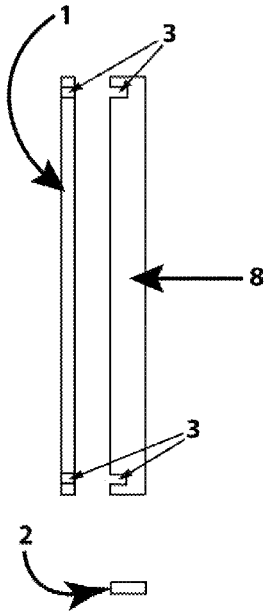
FIG. 2 is a three-sided orthographic view of the side, face, and edge of the "I-shaped" cross-piece component to be used for the notch-slotted, modular base structure form of the invention.
Figure 3:
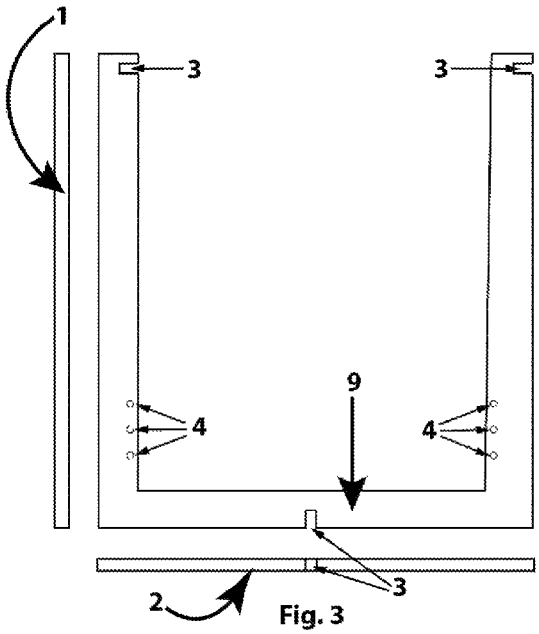
FIG. 3 is a three-sided orthographic view of the side, face, and edge of one of the two "U-shaped" cross-piece components to be used for the notch-slotted, modular base structure form of the invention.
Figure 4:
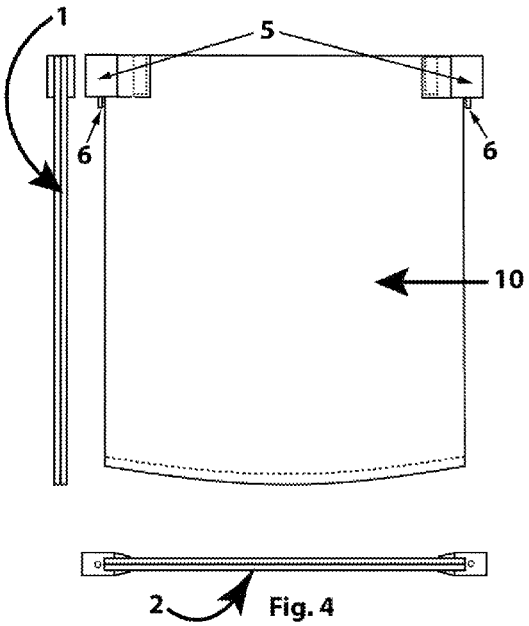
FIG. 4 is a three-sided orthographic view of the side, face, and edge of the seat and backrest component to be used unfolded in either the lounge chair or dining chair configurations, as here shown in a folded position, to be used for the notch-slotted, modular base structure form of the invention.

FIGS. 1 through 3 display orthographic projections of each of the three separate components of this notched, interlocking base structure plus the seat-and-back module FIG. 4 that together can be assembled into a dining chair or lounge chair, or serve as the base to support a work surface, dining table, or cabinet module, as the user may elect. In FIGS. 1 through 3, all notches 3 are cut into the member pieces to the same width as the members themselves, and extend halfway into the width of the member, in order to serve as the tightly-pinioning receptacles for the notched slots in their counterpart pieces. The side views in FIGS. 1 through 4 are numbered 1, and the bottom edge views in each of these figures are numbered 2. The full-on, face view of the flat plane of the H-shaped member that supports the base structure is numbered 7 in FIG. 1. This H-shaped member is composed of three pieces, two arm pieces joined at their centers by a single cross-piece fixed thereto at right angles to each arm piece. The holes 4 in the edge of this member's arms provide a receptacle for the pins 6 in the blocks set to either side of the front edge of the seat portion of the seat-and-back module for the chair when used in the dining chair position. The cross-piece that holds the assembled modules of the base structure together in a cube-like configuration is numbered 8 in FIG. 2. One of the two U-shaped members that are assembled into what forms the side-pieces of the base structure used as a chair is numbered 9 in FIG. 3. Each U-shaped member is also composed of three pieces, two arm pieces joined at their closed end by a single cross-piece fixed thereto at right angles to each arm piece. The holes 4 in the face of this piece provide a receptacle for the pins 6 in the pieces in the back of the seat-and-back module for the chair when used in the lounge chair position. The back-and-seat component shown in FIG. 4 is composed of two similarly sized, flat-folded pieces of fabric, leather, or similar flexible material 10 sewn or glued together at their back edge. Matching pieces of material are positioned as straps 5 to hold blocks of material in place at the outer corners of the seat-and-back component. These blocks hold pins 6 in position to serve to secure the seat-and-chair component into place in the position desired by the user when the modular assembly is to be used as a dining chair FIG. 12, or lounge chair FIGS. 19 and 20.

Figure 5:
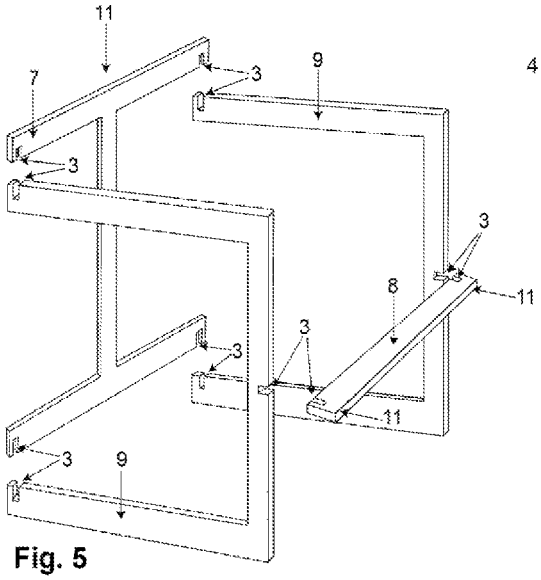
FIG. 5 is a simplified view of the components of the notch-slotted modular base structure form of the invention in the process of being assembled from the components depicted in FIGS. 1 through 4.

FIG. 5 shows the manner in which the base structure components may be assembled 11, by inserting the four components' notches 3 into their appropriately matched counterpart notches 3. As shown, to assemble the base structure into position to serve as the dining chair base, the H-shaped component 7 is positioned with its two "arms" parallel to the ground, and moved downward 11 in a 15 manner that fits its notches 3 into the corresponding notches 3 in the two V-shaped components 9, each of which is positioned with its "open arm" end facing the H-shaped component 7. The I-shaped component 8 as shown in FIG. 5 serves as a linear cross-piece. The I-shaped component 8 is then moved back 11 into the center-slots 3 in the middles of the front edges of the V-shaped components 9.

Figure 6:
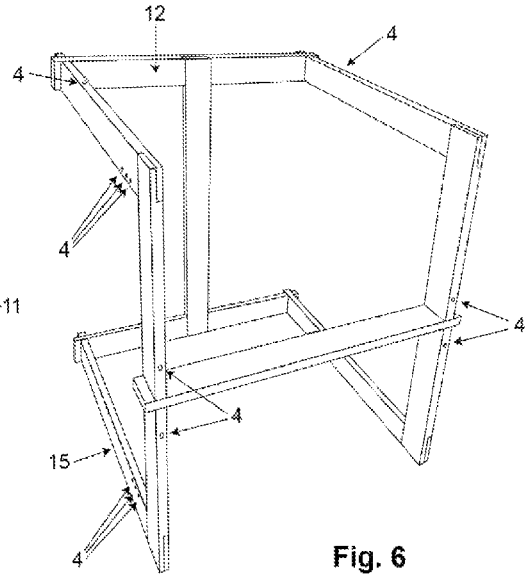
FIG. 6 is a view of the assembled notch-slotted modular base structure form of the invention positioned "upright" to support the removable seat component in a dining or work chair application. In this position, any modules added to the base structure are supported by one upright member at the rear of the base structure and by two upright members at either side of the front of the base structure. All but one of he rectangular boards or bars from which the base structure is composed have their widest sides held in a position at right angles to the floor or other surface on which the base structure rests when the structure is used in this application. The sole exception is the single front-and-center cross-member board which is positioned with its widest side parallel to the floor.
Figure 7:
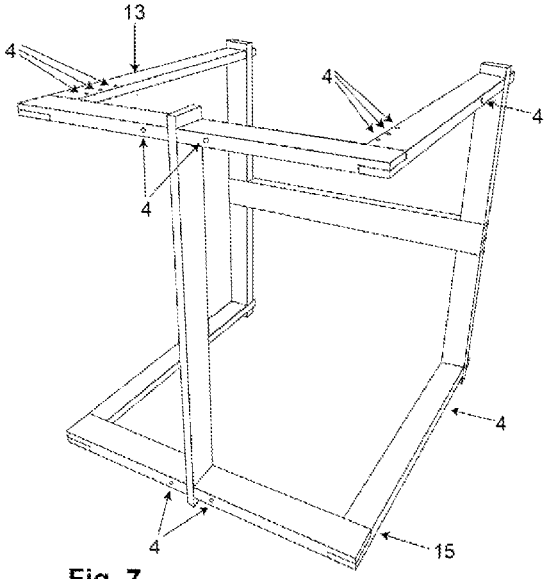
FIG. 7 is a view of the assembled notch-slotted modular base structure form of the invention after it has been rotated ninety degrees along either of the bottom-side axes of the base structure shown in FIG. 6 in order to position the structure in a manner suitable to support the removable seat component in a lounge chair application. Once again, in this position, any modules added to the base structure are supported by one upright member at the rear of the base structure and by two upright members at either side of the front of the base structure. However, in this position, the rectangular boards or bars from which the base structure is composed have their widest sides held parallel to the surface on which the base structure rests when the structure is used in this application.
Figure 8:
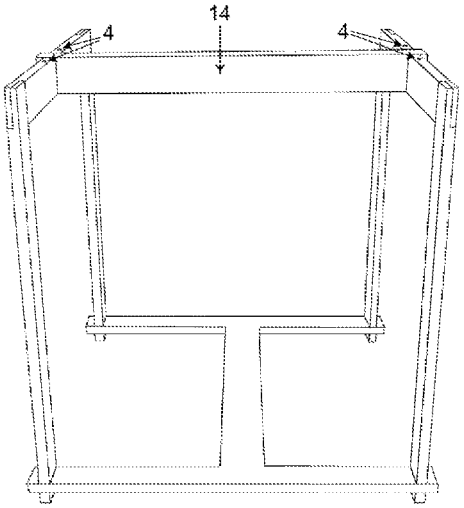
FIG. 8 is a view of the assembled notch-slotted modular base structure form of the invention after it has been rotated a further ninety degrees, in this instance around the front-bottom axis of the base structure shown in FIG. 7, in order to position the structure in a manner suitable to support on its top face the removable leaves of a rigid, modular flat surface in order to serve in a dining or work table application. In this position, any modules added to the base structure are supported by four upright members, one at each corner of the base structure. In this position, the rectangular boards or bars from which the base structure is composed have their widest sides variously disposed with respect to the surface on which the base structure rests.

FIG. 6 illustrates how the assembled base structure 12 in the dining chair position can be rotated 90° counterclockwise around the axis formed by the lower left hand edge 15 of the assembled base structure in order to immediately transform it into the base structure 13 for the lounge chair position shown in FIG. 7. In this instance, if the base structure is rotated 90° clockwise around the axis formed by the lower right hand edge 15, it will form the base structure 14 that can be used to support a tabletop or desktop as shown in FIG. 8.

Figure 9:
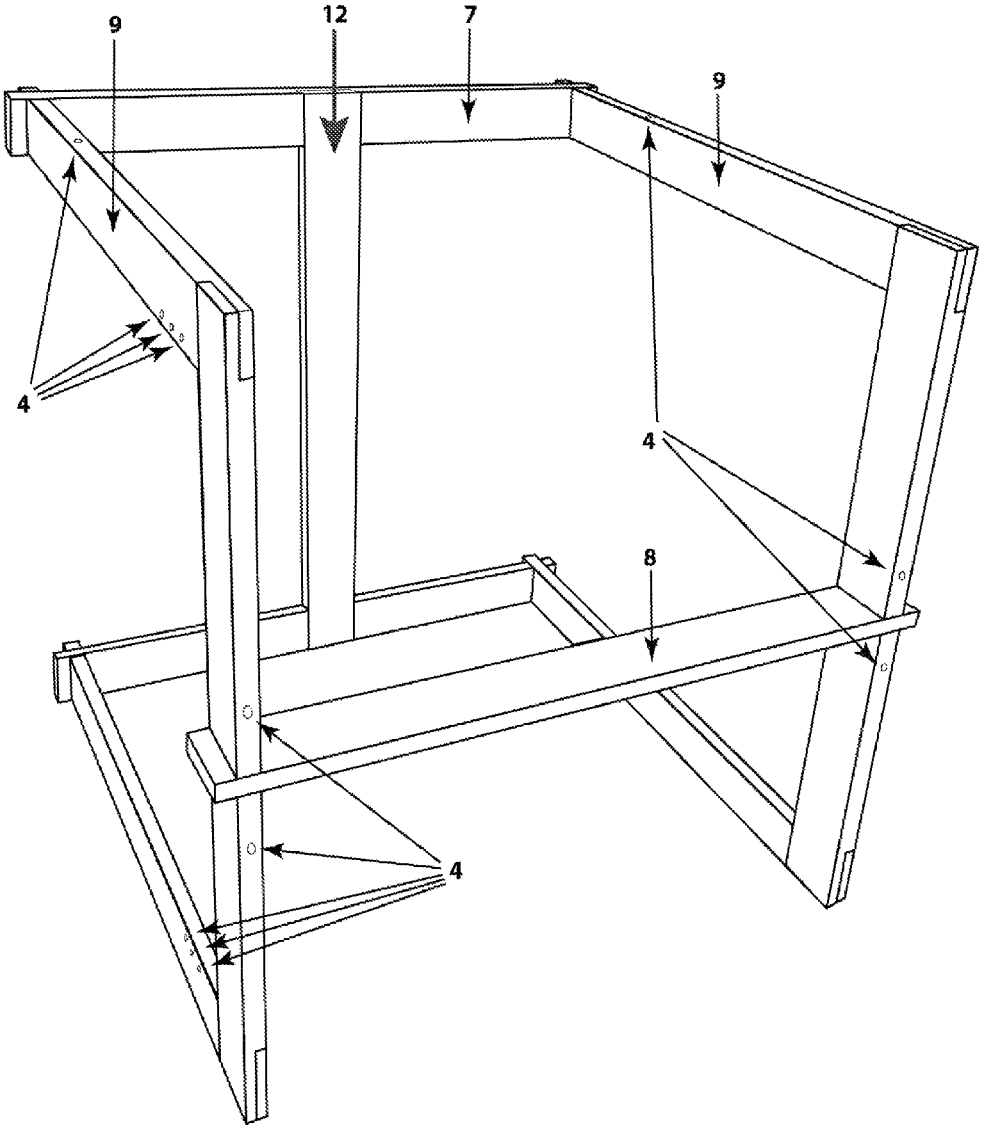
FIG. 9 is a detailed view of the assembled notch-slotted modular base structure form of the invention placed in the dining chair position.
Figure 10:
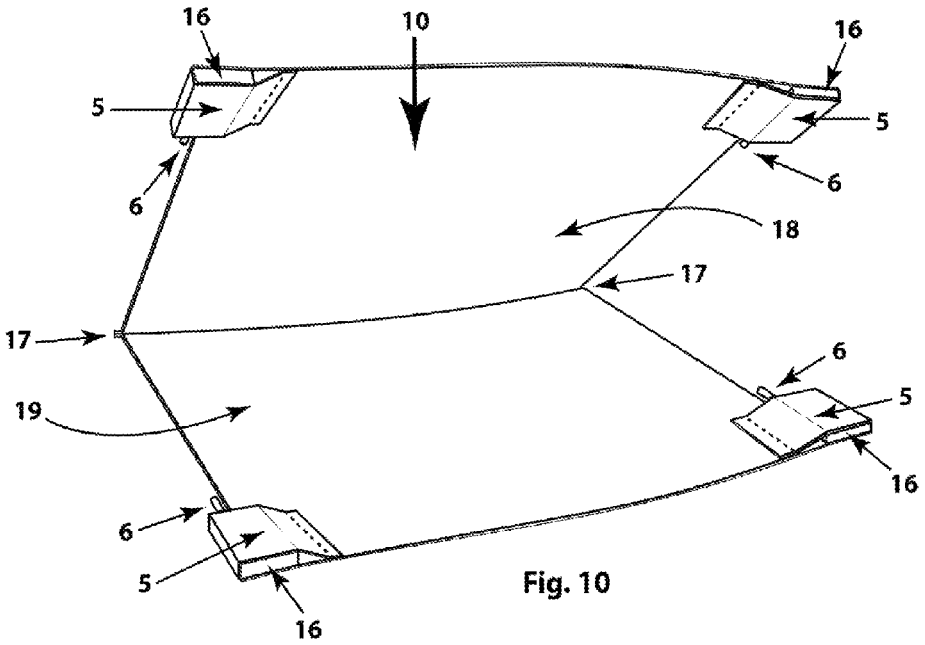
FIG. 10 is a front-side view of the removable, foldable chair seat and back module in the process of being unfolded for use.
Figure 11:
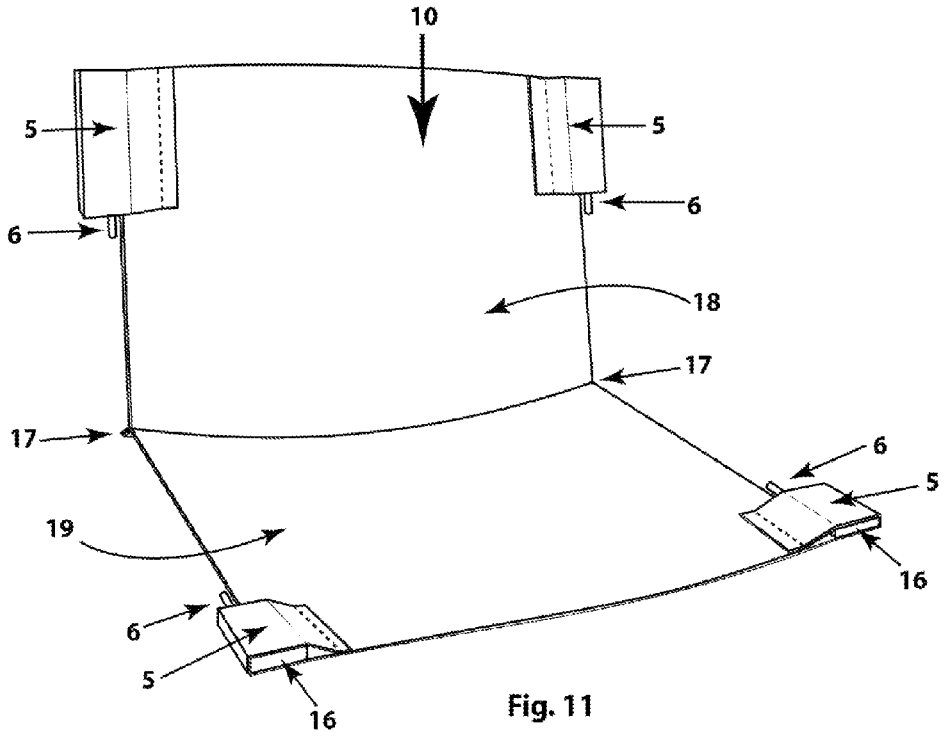
FIG. 11 is a front-side view of the removable, foldable chair seat and back module after being completely unfolded and ready for connection to the base structure so as to permit its use for seating.

FIG. 9 provides a detailed illustration of the components of the base structure when it is assembled and ready for use as a dining chair as shown in FIG. 6. FIG. 10 shows the seat-and-back component 10, including the seat 19 and back 18 sub-components, in a half-unfolded position. FIG. 11 shows the seat-and-back component 10 in a fully unfolded position. Both FIGS. 10 and 11 show the blocks 16 that have been secured to the seat 19 and back 18 by the retaining straps 5, thus positioning the positioning pins 6 that have been secured into the blocks 16 to serve as the means by which this component will support a person who wishes to use the assembled structure as a dining, work, desk, or lounge chair. Both FIGS. 10 and 11 show the joint seam 17 between the materials forming the seat 19 and back 10 at the rear edge of this component.

Figure 12:
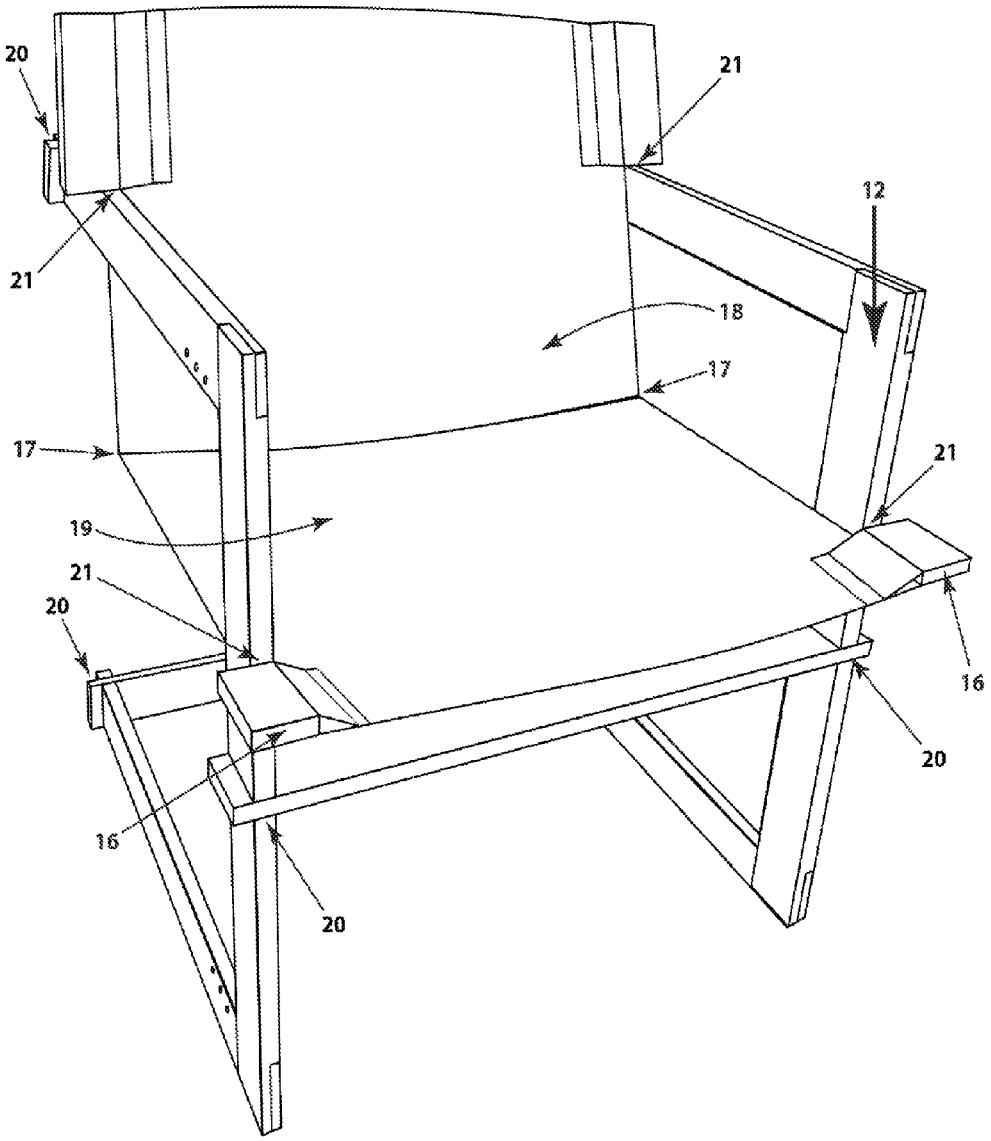
FIG. 12 is a detailed view of the assembled notch-slotted modular base structure connected together with the chair seat and back when the unit is placed in the dining chair position.

FIG. 12 illustrates the base structure in the dining chair position with the seat-and-back component 10 installed, and with the pins 6 inserted into the securing holes 4 and with their junction points 21 hidden behind the supporting blocks 16. Also illustrated here are the intersection points 20 where the notched slots 3 have been tightly fitted into the appropriate receiving slots 3.

Body movements by users of the chair will exert substantial torque on the side walls of these receiving slots 3 in either configuration 12 or 13, where the U-shapes 9 intersect with the H-shape 7 components. These twisting forces will, over time, compress and distort even harder materials, so that the notches 3 begin to widen at their edges, and thus weakening the rigidity of the base structure's assembled configurations for either dining chair 12 or lounge chair 13 applications. In order to prevent such deterioration, movement-restraining components such as those shown in FIGS. 13 through 17 may be employed.

Figure 13:
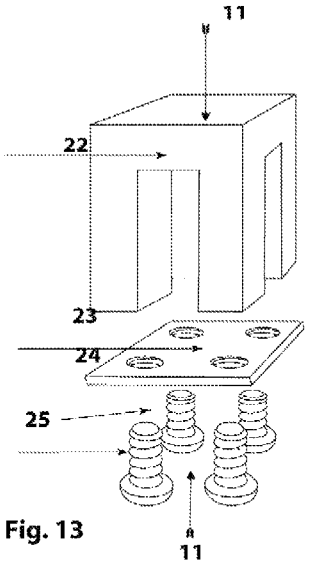
FIG. 13 is a view of a four-legged metal device and screw-affixed metal plate which can be used to secure rigidly orthogonal relationships between each of the base structure's H-shaped back's four notched end segments and the four notched end segments of the arm and horizontal bottom segments of the U-shaped sides of the base structure.
Figure 14:
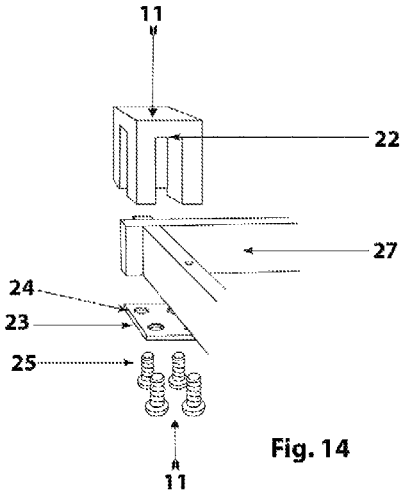
FIG. 14 is a view of the four-legged metal device and screw-affixed metal plate shown in FIG. 13 being readied to be placed over one of the base structure's H-shaped back's notched end segments and one of the notched end segments of the arm of a U-shaped side of the base structure.

FIG. 13 illustrates one solid metal device 22 which can rigidly secure these corner slotted joints in either configuration 12 or 13 against destructive movement induced by torque forces. It uses four parallel square-cross-section legs protruding from a solid base, with each leg terminating in a face which has been drilled and tapped to provide the threads of matching screws 25 with a secure means of rigidly securing the legs against splaying out. It will do so by means of confining the screws in the desired rigid square configuration when they protrude through a secondary square plate 24 with properly spaced holes to hold the screws. FIG. 14 illustrates how the securing devices 22 and 23 are installed 11 into place by means of driving the screws into the holes at the ends of the legs on the base device 22.

Figure 15:
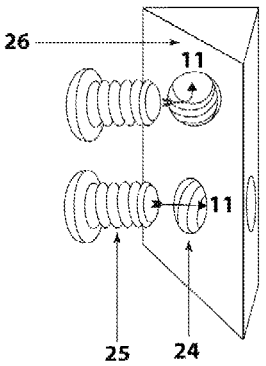
FIG. 15 is a view of a wedge-shaped metal device and the screws which can be used to maintain rigidly orthogonal relationships between each of the base structure's H-shaped back's four notched end segments and the four notched end segments of the arm and horizontal bottom segments of the U-shaped sides of the base structure.
Figure 16:
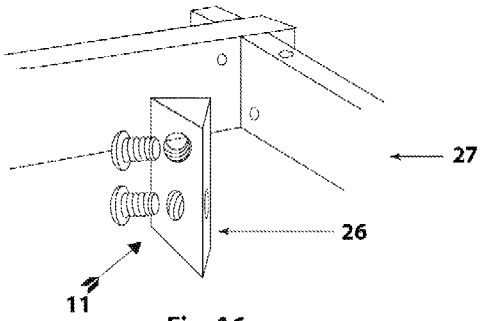
FIG. 16 is a view of the wedge-shaped metal device shown in FIG. 15 being readied to be screwed into the inside corner of one of the base structure's H-shaped back's four notched end segments and a notched end segment of one of the arms of a U-shaped side of the base structure.

FIGS. 15 and 16 illustrate a different type of solid metal device 26 which can rigidly secure these corner slotted joints in either configuration 12 or 13 against those same destructive movement induced by torque forces. This right-triangular cross-sectioned wedge-shaped component fits into the inside corner of these joints and is held rigidly in place by screws 25 fitted through threaded holes 24 in the hypotenuse-sided face of the wedge, into receiving holes threaded into the inside faces of the base structure members at the inside corner joints as shown in FIG. 16.

Figure 17:
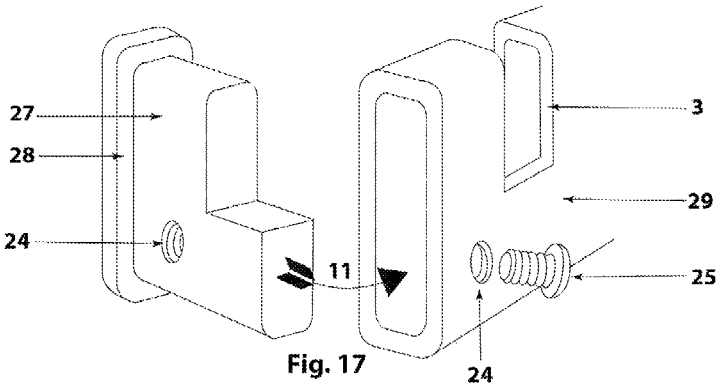
FIG. 17 is a view of a metal piece which is being readied to be inserted and secured by a screw into the hollow receiving end of an extruded, rectangular, tubular plastic member which could be used to form the base structure instead of boards.

FIG. 17 illustrates yet another type of solid metal device 27 which can rigidly secure these corner slotted joints in either configuration 12 or 13 when the structure has been fabricated from hollow tubes 29, such as those made of plastic extrusions with a rectangular cross section of the necessary dimensions. This device would be inserted into the cavity at the open ends of both of the arms of the assembled base structure in configurations 12 or 13 at each intersection of the critical corner joints. In this instance, a rim 28 protruding around the end of the device 27 would help to secure it at the end of each tube, while a screw 25 fitted into a threaded hole 24 would secure the device 27 into place. By placing metal to metal faces against one another within the slotted notch 3, a solidly reinforce means to prevent destructive torque forces from deforming the joint.

Other devices that may be similarly useful but not illustrated herein will be known to those familiar with this kind of mechanical art. These devices may include "hook and eye", "hook and post," and "sliding bolt" devices configured as may be useful to rigidly preserve the inflexible right angle relationships desired at these corner joints.

Figure 18:
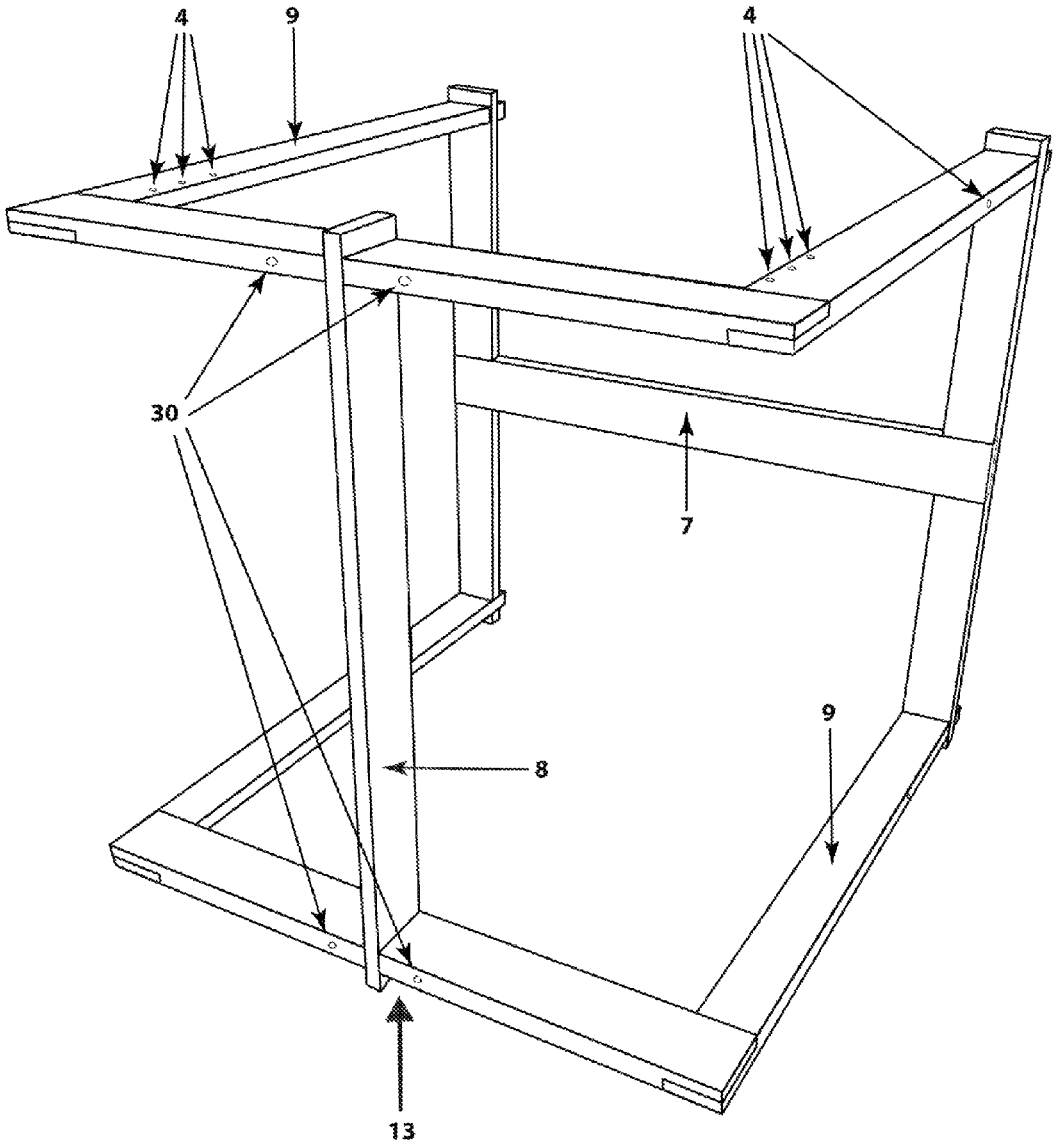
FIG. 18 is a detailed view of the assembled notch-slotted modular base structure form of the invention placed in the lounge chair position.
Figure 19:
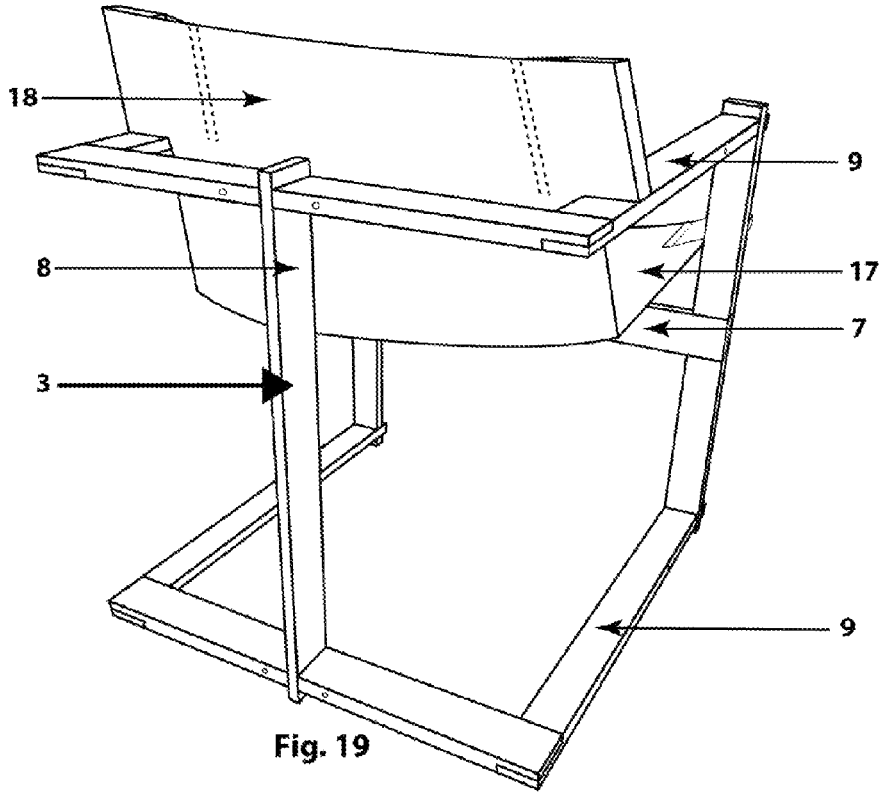
FIG. 19 is a detailed view of the assembled notch-slotted modular base structure connected together with the chair seat and back when the unit is placed in the lounge chair position.

FIG. 18 provides a detailed illustration of the components of the base structure when it is assembled and ready for use as a lounge chair as shown in FIG. 7. FIG. 19 shows the seat-and-back component 10, including the seat 19 and back 18 sub-components installed in the base structure 13 and ready for seating. FIG. 11 shows the seat-and-back component 10 in a fully unfolded position. The holes 4 into which pins 6 used to position either the seat-and-backrest module 10 or the table-top module 34 or the cabinet module 37 in their respective places are illustrated in FIG. 18. FIG. 20 shows how the seat-and-backrest module 10 can be set to various positions and inclination as in 31, 32, and 33 by means of moving the positions in which the pins 6 are selectively inserted into alternative holes 21.

FIG. 21 illustrates how two planar components 34 may be joined to each other by inserting pins 36 in one component's interior edge into correspondingly positioned receiving holes in the respective facing edges of the other such component 34. Once so joined into a single component, the lower surface of this component is lowered onto the top face of the base structure 14 that has been positioned so as to serve as a work or dining surface's base module. Alternatively, the two planar components 34 may be foldably joined to each other at their facing edges by means of a hinge or hinges. The tabletop component 34 features retaining pins 35 that fit into receiving holes 30 in corresponding positions on the upper edges of the top face of the supporting base structure 14.

FIG. 22 illustrates the base structure in the same position as is used in the dining chair base structure positioned as in FIG. 12, in this instance in order to serve to support a cabinet module 37. As illustrated this cabinet contains three stacked drawers 39, each of which provide storage space for contents that may be accessed by pulling forward the knobs 39 shown on the faces of these drawers 39.

Alternatively to the use of drawers 39 for storage, storage space within the cabinet 37 might be accessed by positioning a hinged door or doors on the face of the cabinet insert, or simply left open with the bottom of the cabinet serving as a shelf. The cabinet insert module 37 is held in place by means of an overlapping edge 41 to the top surface of the cabinet 38, which is retained in place by the arm components 9 at the upper edge of the base structure 12, as well as by the front edge of the cabinet resting on the cross-piece 8 at the middle of the front face of the base structure 12.

Figure 23:
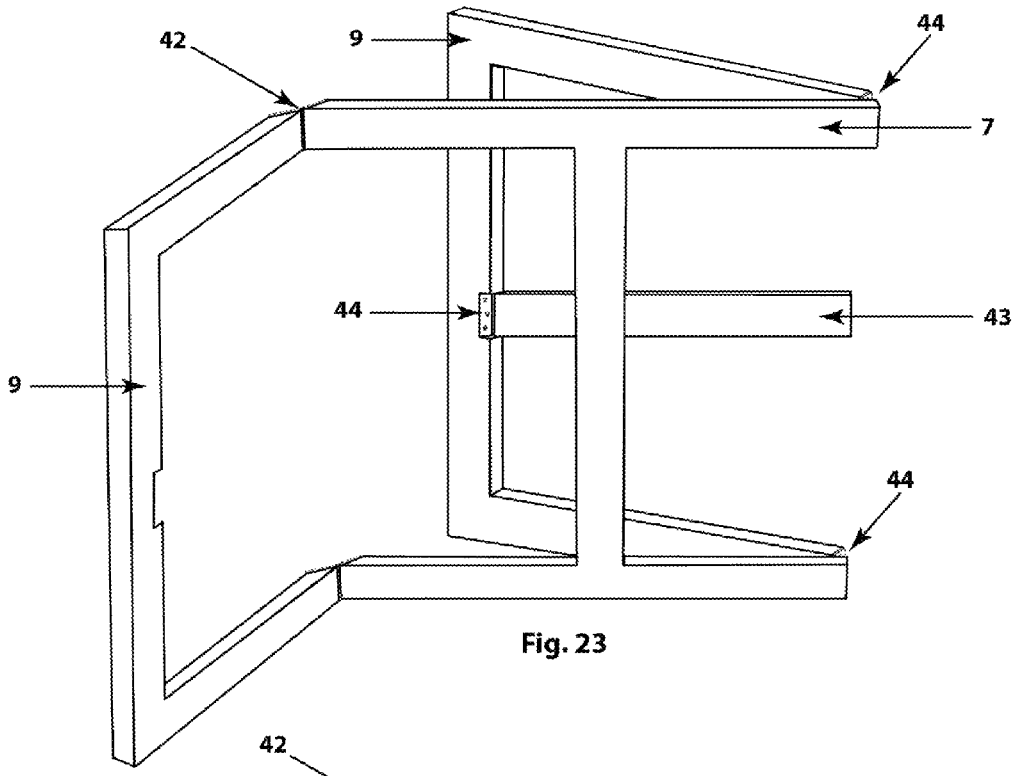
FIG. 23 is a view of an alternative means of constructing the base structure, in this instance using rectangular boards with hinges in place of the notched slots shown in FIG. 5.
Figure 24:
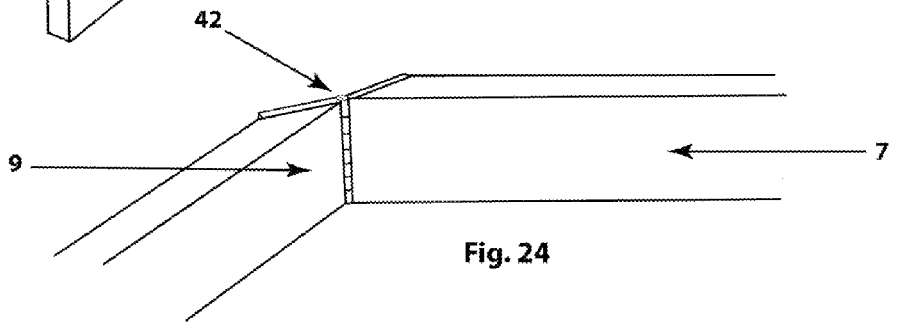
FIG. 24 shows a detailed view of one of the hinges in place between one arm of the H-shaped back of the base structure and one of the U-shaped supports on the side.
Figure 25:
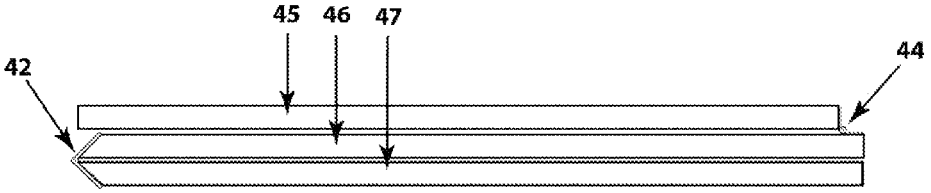
FIG. 25 is a top-down view of the base structure shown in FIG. 23 after it has been completely folded into a flat assembly.

FIGS. 23, 24, and 25 illustrate various views of an alternative means of constructing the base structure. In this instance, assembly and deconstruction of the base is simplified for the user, since all of the component pieces of the base structure—the H-shape 7, the two U-shaped 9s, and a cross piece 43—are connected appropriately together by means of hinges 42 and 44 which have been screwed into the base structure's members, or similarly affixed as by welds in the case of a frame composed of metal bars. FIG. 23 shows this form of the base structure module in a partially opened or unfolded position. FIG. 24 shows a close-up view of the intersection at the outside corner joints of component assemblies 7 and 9, and the diagonal cuts made into the end-faces of each assembly in order to permit the hinge to fold and unfold in a manner that permits the base structure to assume the desired cubical form when unfolded and yet to fold completely flat as shown in a top view of the base structure in FIG. 24 when not in use. The two U-shaped components 45 and 47 are shown enclosing the H-shaped component 46 in this view, with the right-angled hinged joint at 44 and the diagonally cut end pieces of the joint at 42.

Figure 26:
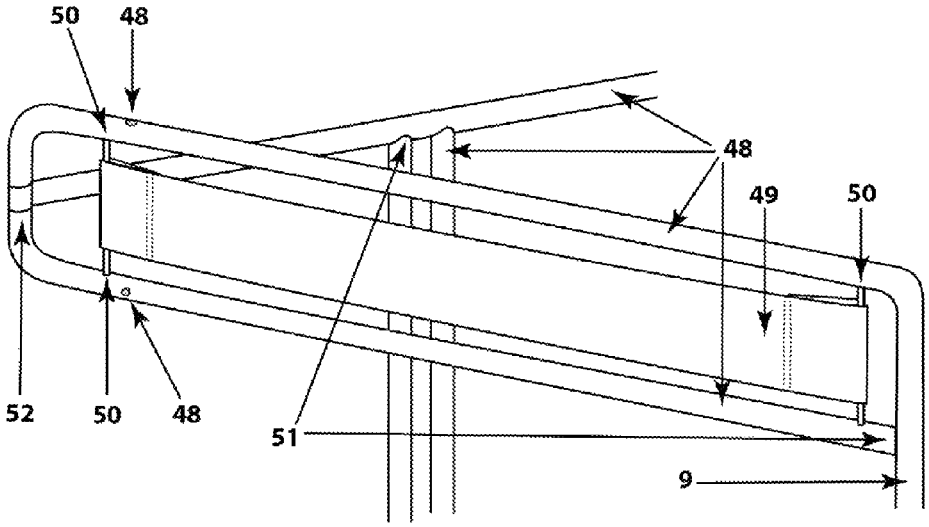
FIG. 26 is a view of one corner of the top of yet another type of base structure in the dining chair position, in this instance with the framework of the structure being composed of metal tubing, and with the armrests for the lounge chair position being composed of leather or fabric straps.
Figure 27:
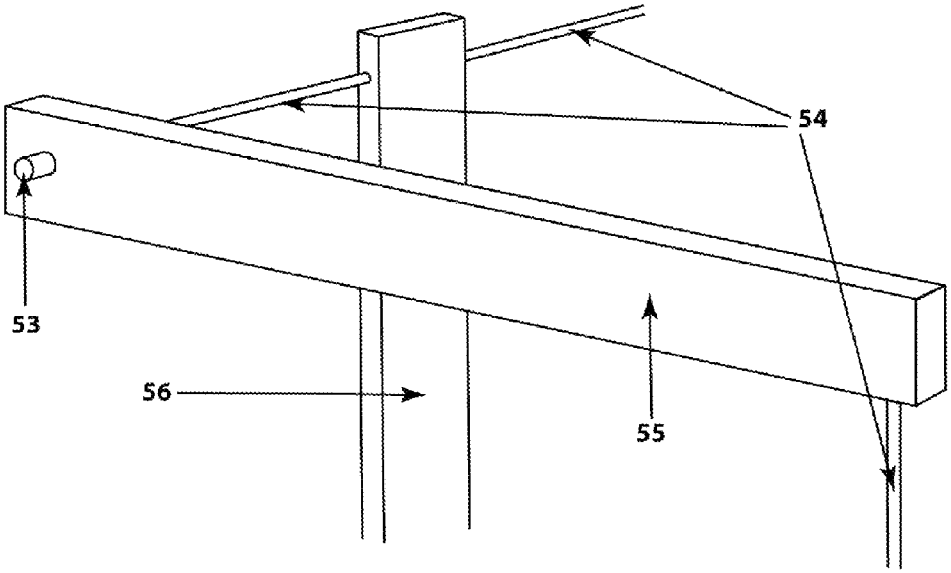
FIG. 27 is a view of one corner of the top of one more type of base structure in the dining chair position, here shown with the rectangular arms and center-member of the H-shape back structure being composed of boards, and with the rest of the structure composed of metal rods secured into place by means of hand-tightened nuts on the protruding terminations of these rods.

FIGS. 26 and 27 illustrate two additional ways in which the base structure may be composed. The construction shown in FIG. 26 is much like the base structure shown in FIGS. 23 through 25, in that the components are connected by hinges 52, in this instance with hinges concealed within the tubular metal pieces 48 out of which the structure derives its mechanical strength and rigidity. These tubular elements are connected to each other either by means of welded joints 51, or by the fitting of end pieces 52 over concealed interior tubes or rods which permit these joints to serve as hinges. In this form of the base structure, armrests are provided by straps 49 made of leather or other flexible material which can be stretched into place and held by smaller rods 50 between the inner and outer tubes which frame the armrest structure within this section of the U-shaped components 9. Here again, appropriately spaced holes 48 in the tubular components provide rigid support for the pins 6 in the various modules to be inserted into, and supported by, the base structure's frame. FIG. 27 is even more of departure from preceding structures, in that all of its subcomponents may easily be assembled or disassembled into straight pieces of either the requisite rectangular cross sections 55 and 56, and into connecting rods 54 with threaded ends to hold nuts 53 which will secure the assembled components into a single base structure unit. This means of construction will permit the disassembled structure to be stored within a single cylinder of roughly two feet in length.

The nature of the improvements embodied in this invention mechanically simplify and improve the performance of prior art, in the interests of economy of cost of production and utilization, compact storage, flexible applications, and broader utility. It is understood that its novel features, as shown and as described in the annexed claims, can be changed in its details of operation and configuration by those skilled in the art without departing from the essence of the invention It should further be apparent to those skilled in the art that various changes in form and details of the invention as shown and described may be made. It is intended that such changes be included within the spirit and scope of the claims appended hereto.

I claim:

1. A furniture system composed of a base structure with at least one of a foldably hinged or a connectible-component mode, and modules which together can be assembled into multiple modes, including: lounge armchairs, dining armchairs tables and storage cabinet applications, with said base structure comprising:

two rectilinear U-shaped components having rectangular cross-sections for the arms which extend from the cross-piece at the closed end of the U-shapes, with the broader sides of all the pieces of the U-shape forming flat planes on both sides of said U-shaped pieces, and equipped with interlocking notches or hinges near or at the open end of the U-shaped pieces arms, and one H-shaped rectilinear component with a center cross-piece fixed at right angles to the two arms of said H-shaped component, which center piece is positioned parallel to the cross-pieces at the closed ends of the U-shaped components in the assembled base structure, and with corresponding matched notches or hinges near or at the four outer ends of the two arms of the H-shaped component which interlock the H-shaped component to the two U-shaped components when the base is assembled; and a linear cross-piece component which is positioned parallel to the two parallel arms of the H-shaped component in the assembled base structure, and is fitted into corresponding notches or hinged at the center position of the closed ends of the U-shaped components when the base structure is assembled; wherein:

the length of the arms of the U-shaped component are sufficiently greater than the width of the arms of the H-shaped structure to permit the assembled dining chair application to fit underneath the bottom surface of the assembled dining table's top, and where the width of the space between the inner faces of the U-shaped components in the assembled base structure is identical to the width of the space between the inner edges of the arms of the U-shaped components thus permitting a single seat-and-backrest module to be used in both dining chair and lounge chair applications, wherein the intersecting and connected corners of the H-shaped component and the U-shaped components are reinforced with rigid, installable and removable reinforcing devices fitted into or around these corners or the ends of these components or by rigidly braced diagonal hinges.

2. A furniture system composed of a base structure with at least one of a foldably hinged or a connectible-component mode, and modules which together can be assembled into multiple modes, including: lounge armchairs, dining armchairs, tables, and storage cabinet applications, with said base structure comprising:

two rectilinear U-shaped components having rectangular cross-sections for the arms which extend from the cross-piece at the closed end of the U-shapes, with the broader sides of all the pieces of the U-shape forming flat planes on both sides of said U-shaped pieces, and equipped with interlocking notches or hinges near or at the open end of the U-shaped pieces arms, and one H-shaped rectilinear component with a center cross-piece fixed at right angles to the two arms of said H-shaped component, which center piece is positioned parallel to the cross-pieces at the closed ends of the U-shaped components in the assembled base structure, and with corresponding matched notches or hinges near or at the four outer ends of the two arms of the H-shaped component which interlock the H-shaped component to the two U-shaped components when the base is assembled:

seating applications which are assembled by means of affixing a single piece, foldable seat-and-backrest module into the desired position by the user's selection of alternative holes in the base structure's arms in which to insert pins protruding from fixed positions near the corners of the seat-and-backrest module: and a linear cross-piece component which is positioned parallel to the two parallel arms of the H-shaped component in the assembled base structure, and is fitted into corresponding notches or hinged at the center position of the closed ends of the U-shaped components when the base structure is assembled; wherein:

the length of the arms of the U-shaped component are sufficiently greater than the width of the arms of the H-shaped structure to permit the assembled dining chair application to fit underneath the bottom surface of the assembled dining table's top and where the width of the space between the inner faces of the U-shaped components in the assembled base structure is identical to the width of the space between the inner edges of the arms of the U-shaped components thus permitting a single seat-and-backrest module to be used in both dining chair and lounge chair applications.

3. A furniture system composed of a base structure with at least one of a foldably hinged or a connectible-component mode, and modules which together can be assembled into multiple modes, including: lounge armchairs, dining armchairs, tables and storage cabinet applications, with said base structure comprising:

two rectilinear U-shaped components having rectangular cross-sections for the arms which extend from the cross-piece at the closed end of the U-shapes, with the broader sides of all the pieces of the U-shape forming flat planes on both sides of said U-shaped pieces, and equipped with interlocking notches or hinges near or at the open end of the U-shaped pieces arms, and one H-shaped rectilinear component with a center cross-piece fixed at right angles to the two arms of said H-shaped component, which center piece is positioned parallel to the cross-pieces at the closed ends of the U-shaped components in the assembled base structure, and with corresponding matched notches or hinges near or at the four outer ends of the two arms of the H-shaped component which interlock the H-shaped component to the two U-shaped components when the base is assembled;

a work surface application in which at least one flat surfaced tabletop affixed to said furniture system via pins and holes or hinges; and a linear cross-piece component which is positioned parallel to the two parallel arms of the H-shaped component in the assembled base structure, and is fitted into corresponding notches or hinged at the center position of the closed ends of the U-shaped components when the base structure is assembled; wherein:

the length of the arms of the U-shaped component are sufficiently greater than the width of the arms of the H-shaped structure to permit the assembled dining chair application to fit underneath the bottom surface of the assembled dining table's top, and where the width of the space between the inner faces of the U-shaped components in the assembled base structure is identical to the width of the space between the inner edges of the arms of the U-shaped components thus permitting a single seat-and-backrest module to be used in both dining chair and lounge chair applications.

4. A furniture system composed of a base structure with at least one of a foldably hinged or a connectible-component mode, and modules which together can be assembled into multiple modes, including: lounge armchairs, dining armchairs, tables, and storage cabinet applications, with said base structure comprising:

two rectilinear U-shaped components having rectangular cross-sections for the arms which extend from the cross-piece at the closed end of the U-shapes, with the broader sides of all the pieces of the U-shape forming flat planes on both sides of said U-shaped pieces, and equipped with interlocking notches or hinges near or at the open end of the U-shaped pieces arms, and one H-shaped rectilinear component with a center cross-piece fixed at right angles to the two arms of said H-shaped component, which center piece is positioned parallel to the cross-pieces at the closed ends of the U-shaped components in the assembled base structure, and with corresponding matched notches or hinges near or at the four outer ends of the two arms of the H-shaped component which interlock the H-shaped component to the two U-shaped components when the base is assembled;

a storage cabinet application wherein insertion of a cabinet storage module onto the upper portion of the base structure which may be positioned in either the dining chair rotation, or in the position in which it could serve as a lounge chair, supported by the protruding edge of the top surface of the cabinet module which rests on the upper edge of the U-shaped and H-shaped components of the base structure; and a linear cross-piece component which is positioned parallel to the two parallel arms of the H-shaped component in the assembled base structure, and is fitted into corresponding notches or hinged at the center position of the closed ends of the U-shaped components when the base structure is assembled; wherein:

the length of the arms of the U-shaped component are sufficiently greater than the width of the arms of the H-shaped structure to permit the assembled dining chair application to fit underneath the bottom surface of the assembled dining table's top, and where the width of the space between the inner faces of the U-shaped components in the assembled base structure is identical the width of the space between the inner edges of the arms of the U-shaped components thus permitting a single seat-and-backrest module to be used in both dining chair and lounge chair applications.

5. A furniture system composed of a base structure with at least one of a foldably hinged or a connectible-component mode, and modules which together can be assembled into multiple modes, including: lounge armchairs, dining armchairs, tables, and storage cabinet applications, with said base structure comprising:

two rectilinear U-shaped components which extend from the cross-piece at the closed end of the U-shapes, with the broader sides of all the pieces of the U-shape forming flat planes on both sides of said U-shaped pieces, and equipped with interlocking notches or hinges near or at the open end of the U-shaped pieces arms, and one H-shaped rectilinear component with a center cross-piece fixed at right angles to the two arms of said H-shaped component, which center piece is positioned parallel to the cross-pieces at the closed ends of the U-shaped components in the assembled base structure, and with corresponding matched notches or hinges near or at the four outer ends of the two arms of the H-shaped component which interlock the H-shaped component to the two U-shaped components when the base is assembled;

a linear cross-piece component which is positioned parallel to the two parallel arms of the H-shaped component in the assembled base structure, and is fitted into corresponding notches or hinged at the center position of the closed ends of the U-shaped components when the base structure is assembled; wherein:

the length of the arms of the U-shaped component are sufficiently greater than the width of the arms of the H-shaped structure to permit the assembled dining chair application to fit underneath the bottom surface of the assembled dining table's top, and where the width of the space between the inner faces of the U-shaped components in the assembled base structure is identical to the width of the space between the inner edges of the arms of the U-shaped components thus permitting a single seat-and-backrest module to be used in both dining chair and lounge chair applications;

wherein the base structure is composed of rigid tubular U-shaped and H-shaped components connected by means of interior hinges, and equipped with flexible straps suspended in the center sections of the U-shaped components' arm extensions.

* * * * *